US008650777B2

(12) United States Patent
Hsu

(10) Patent No.: US 8,650,777 B2
(45) Date of Patent: Feb. 18, 2014

(54) ILLUMINANT SHOE

(76) Inventor: Cheng-Chung Hsu, Taichung (TW)

( * ) Notice: Subject to any disclaimer, the term of this patent is extended or adjusted under 35 U.S.C. 154(b) by 490 days.

(21) Appl. No.: 13/155,587

(22) Filed: Jun. 8, 2011

(65) Prior Publication Data

US 2012/0192462 A1 Aug. 2, 2012

(30) Foreign Application Priority Data

Jan. 28, 2011 (TW) ..... 100202067 U

(51) Int. Cl.
*A43B 23/24* (2006.01)

(52) U.S. Cl.
USPC ..... 36/127; 362/103

(58) Field of Classification Search
USPC ..... 36/136, 137; 362/103
See application file for complete search history.

(56) References Cited

U.S. PATENT DOCUMENTS 5,599,088 A * 2/1997 Chien ..... 362/103
5,732,486 A * 3/1998 Rapisarda ..... 36/137
5,865,523 A * 2/1999 Chien ..... 362/84
5,969,479 A * 10/1999 Wong ..... 315/200 A
7,152,345 B2 * 12/2006 Koenig ..... 36/136
7,204,045 B2 * 4/2007 Lee ..... 36/137
7,607,243 B2 * 10/2009 Berner et al. ..... 36/136
2004/0103563 A1 * 6/2004 Linge ..... 36/137
2005/0150138 A1 * 7/2005 Guzman ..... 36/137

* cited by examiner

*Primary Examiner* — Marie Patterson
(74) *Attorney, Agent, or Firm* — Pai Patent & Trademark Law Firm; Chao-Chang David Pai

(57) ABSTRACT

An illuminant shoe has a body, an outsole and an illuminating device. The body has a putting segment, a lifting cover and an insole. The putting segment has a heel lining and a through hole. The lifting cover is connected to the heel lining. The insole is mounted in the putting segment. The outsole is mounted on the putting segment and has a mounting chamber. The illuminating device is mounted in the mounting chamber and has an illuminating module, a controlling module and a switch. The illuminating module has first wires, multiple illuminating elements and a first electrical element. The controlling module is connected to the illuminating module and has two second electrical elements, multiple second wires, a controlling unit, a battery and a protecting casing. The switch is mounted in the putting segment, is connected to the controlling module and has a third wire and a third electrical element.

8 Claims, 7 Drawing Sheets

ILLUMINANT SHOE

BACKGROUND OF THE INVENTION

1. Field of the Invention

The present invention relates to an illuminant shoe, and more particularly to an illuminant shoe that can provide a preferred visible effect and can replace the extinct battery conveniently.

2. Description of Related Art

Conventional shoes are used to protect feet of users and simultaneously provide a decorative effect. The conventional shoes are always designed to have different appearances to fit with different user's needs. Some of the conventional shoes have illuminant devices to provide an illuminating effect.

With reference to FIG. 7, a conventional illuminant shoe has a body 70 and an illuminating device 80. The body 70 has a front segment 71, a rear segment 72 and a putting space 73. The putting space 73 is formed between the front segment 71 and the rear segment 72 to enable the user's foot to put in the body 70. The illuminating device 80 is sealed and mounted in the body 70 and has a controlling module 83, an illuminating module 81, a switch 82 and a power supply element 84. The controlling module 83 is mounted in the body 70 near the rear segment 72. The illuminating module 81 is mounted in the front segment 71 of the body 70, is electrically connected to the controlling module 83 and can emit light out of the front segment 71 of the conventional illuminant shoe. The switch 82 is electrically mounted on the controlling module 83 and can be controlled by a user to transmit a signal to the controlling module 83 to enable the illuminating module 81 to turn on or off. The power supply element 84 is mounted on the controlling module 83 and supplies power to the illuminating module 81 and the controlling module 83.

However, the power supply element 84 of the illuminating device 80 of the conventional illuminant shoe is a disposable battery but the whole illuminating device 80 is sealed and mounted in the body 70. When the power of the disposable battery is used up, the conventional illuminant shoe cannot change a new battery and the practicability of the conventional illuminant shoe is limited. Furthermore, the illuminating module 81 is mounted in the front segment 71 of the body 70, so the emitting angle of the illuminating module 81 is limited and the illuminating module 81 cannot provide a preferred visible effect.

To overcome the shortcomings, the present invention provides an illuminant shoe to mitigate or obviate the aforementioned problems.

SUMMARY OF THE INVENTION

The main objective of the present invention is to provide an illuminant shoe that can provide a preferred visible effect and can replace the extinct battery conveniently.

The illuminant shoe in accordance with the present invention has a body, an outsole and an illuminating device. The body has a putting segment, a lifting cover and an insole. The putting segment has a heel lining and a through hole. The lifting cover is connected to the heel lining to cover the through hole. The insole is mounted in the putting segment and abuts the heel lining and the lifting cover. The outsole is mounted on the bottom of the putting segment and has a mounting chamber. The illuminating device is mounted in the mounting chamber of the outsole and has an illuminating module, a controlling module and a switch. The illuminating module is mounted in the mounting chamber and has multiple first wires, multiple illuminating elements and a first electrical element. The controlling module is mounted in the mounting chamber, is electrically and detachably connected to the illuminating module and has two second electrical elements, multiple second wires, a controlling unit, a battery and a protecting casing. The switch is mounted in the putting segment, is detachably connected to one of the second electrical elements and has a third wire and a third electrical element.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
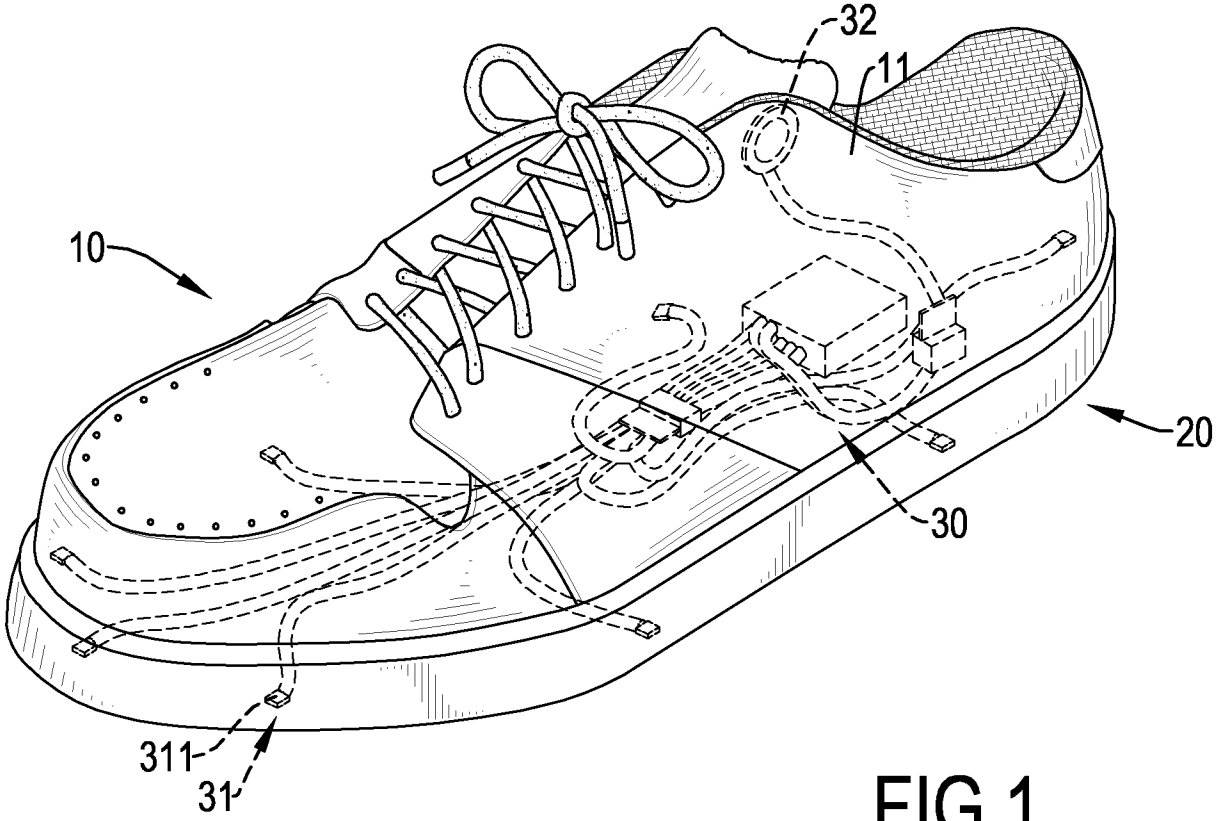
FIG. 1 is a perspective view of an illuminant shoe in accordance with the present invention.
Figure 2:
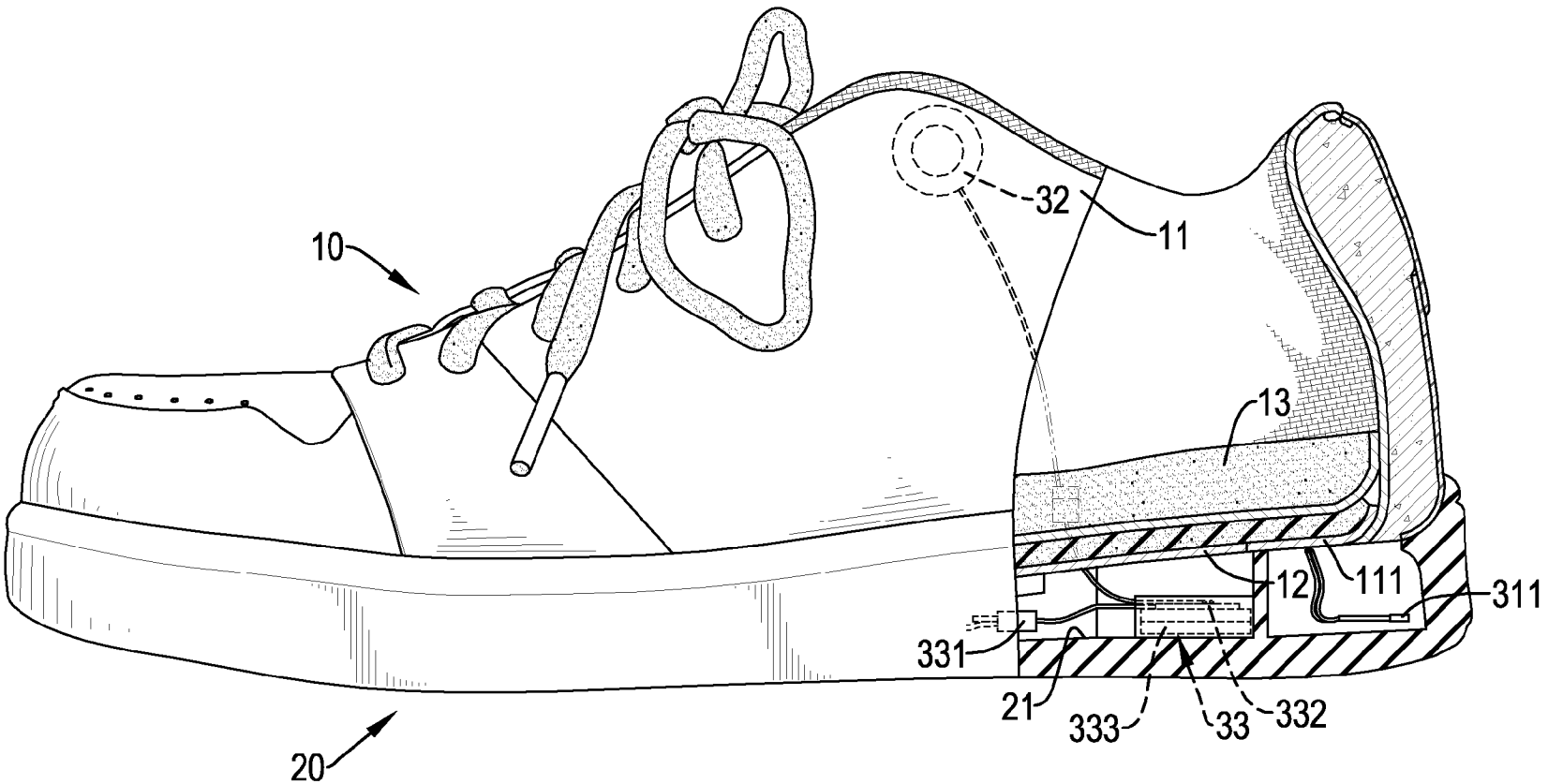
FIG. 2 is an enlarged side view in partial section of the illuminant shoe in FIG. 1.
Figure 3:
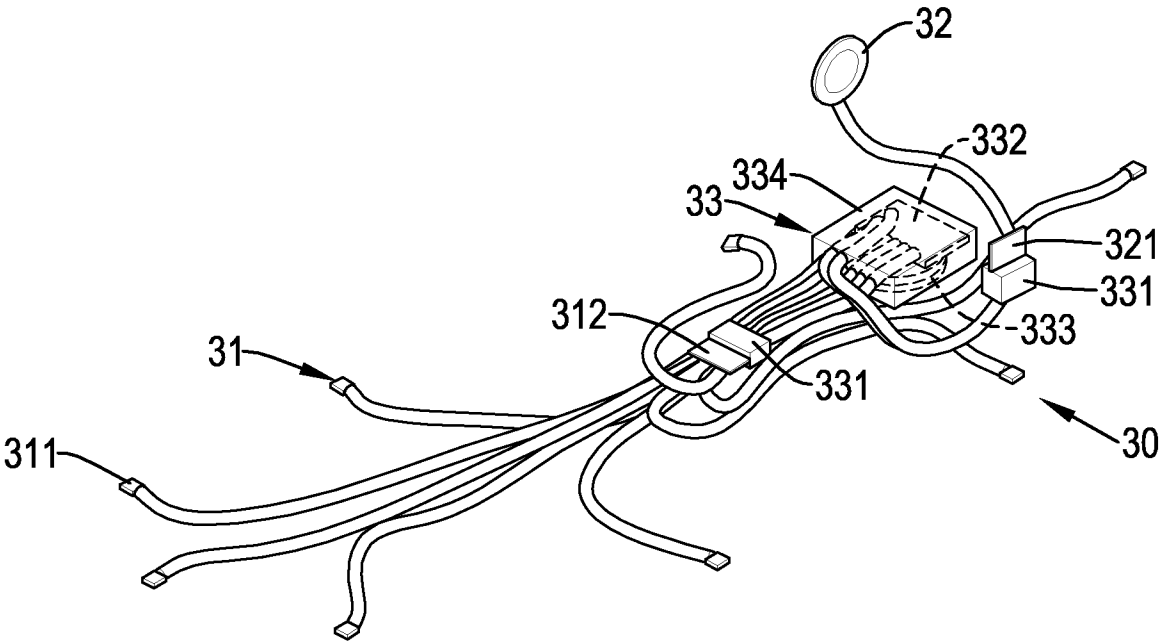
FIG. 3 is an enlarged perspective view of an illuminating device of the illuminant shoe in FIG. 1.

With reference to FIGS. 1 to 3, an illuminant shoe in accordance with the present invention comprises a body 10, an outsole 20 and an illuminating device 30.

Figure 5:
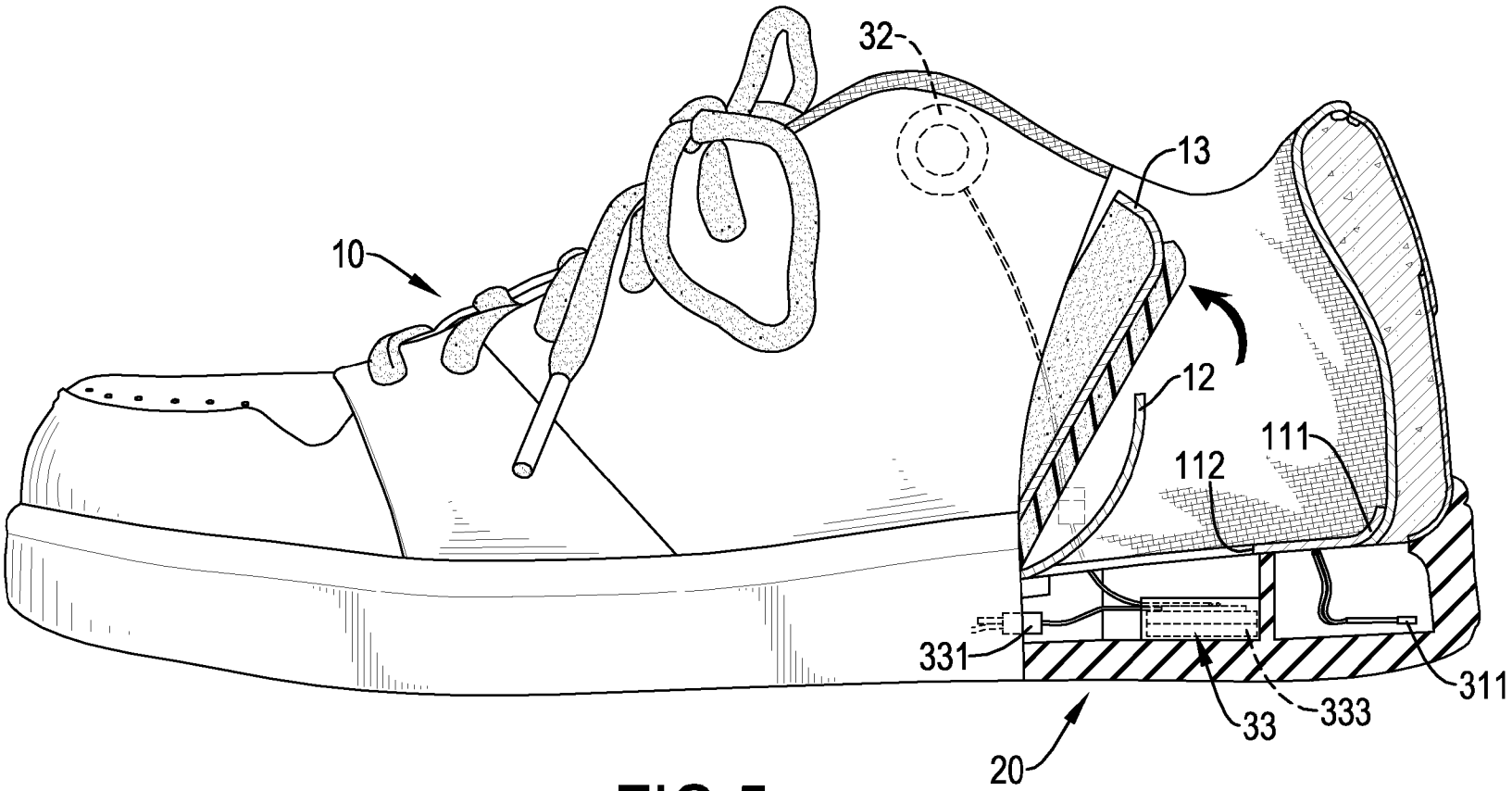
FIGS. 5 and 6 are operational side views in partial section of the illuminant shoe in FIG. 1.

With further reference to FIG. 5, the body 10 has a putting segment 11, a lifting cover 12 and an insole 13. The putting segment 11 is used to enable a user's foot to put in the body 10 and has a bottom, a rear end, a heel lining 111 and a through hole 112. The heel lining 111 is mounted in the bottom of the putting segment 11. The through hole 112 is formed through the heel lining 111 near the rear end of the putting segment 11. The lifting cover 12 is connected to the heel lining 111 to cover the through hole 112 and can be lifted upward relative to the heel lining 111 of the putting segment 11. The insole 13 is mounted in the putting segment 11 and abuts the heel lining 111 and the lifting cover 12.

With reference to FIG. 2, the outsole 20 may be made of a translucent material, is mounted on the bottom of the putting segment 11 of the body 10 and has a top, a bottom, an external sidewall and a mounting chamber 21. The mounting chamber 21 is formed in the top of the outsole 20 and between the heel lining 111 of the putting segment 11, the lifting cover 12 and the bottom of the outsole 20 and communicates with the through hole 112 of the putting segment 11.

With reference to FIGS. 1 to 3, the illuminating device 30 is mounted in the mounting chamber 21 of the outsole 20 and has an illuminating module 31, a controlling module 33 and a switch 32. The illuminating module 31 is mounted in the mounting chamber 21 of the outsole 20 and has multiple first wires, multiple illuminating elements 311 and a first electrical element 312. The first wires are mounted in the mounting chamber 21 of the outsole 20 and extend to the external sidewall of the outsole 20 in a radial direction, and each first wire has an extending end and a connecting end. The extending ends of the first wires individually extend to the external sidewall of the outsole 20. The illuminating elements 311 may be light-emitting diodes (LEDs), are respectively connected to the extending ends of the first wires and extend out of the external sidewall of the outsole 20 to emit lights out of the outsole 20. The first electrical element 312 may be a connector or a receiving mount and is connected to the connecting ends of the first wires.

The controlling module 33 is mounted in the mounting chamber 21 of the outsole 20 below the lifting cover 12, is electrically and detachably connected to the illuminating module 31 and has two second electrical elements 331, multiple second wires, a controlling unit 332, a battery 333 and a protecting casing 334. The second electrical elements 331 may be connectors or receiving mounts, and one of the second electrical elements 331 is connected to the first electrical element 312 of the illuminating module 31. The second wires are connected to the second electrical elements 331. The controlling unit 332 is mounted in the mounting chamber 21 of the outsole 20 and is electrically connected to the second wires. The battery 333 is electrically connected to the controlling unit 332 and supplies power to the illuminating module 31 and the controlling module 33. The protecting casing 334 is mounted in the mounting chamber 21 of the outsole 20 and is mounted around the controlling unit 332 and the battery 333.

The switch 32 may be a pushbutton switch, is mounted in the putting segment 11 above the heel lining 111, is detachably connected to the other second electrical element 331 of the controlling module 33 that is free from connecting with the first electrical element 312 of the illuminating module 31 and has a third wire and a third electrical element 321. The third wire is mounted in the mounting chamber 21 of the outsole 20 and extends out of the bottom of the putting segment 11 via the heel lining 111 or the lifting cover 12. The third electrical element 321 may be a connector or a receiving mount, is electrical connected to the third wire and is electrically connected to the corresponding second electrical element 331.

Figure 4:
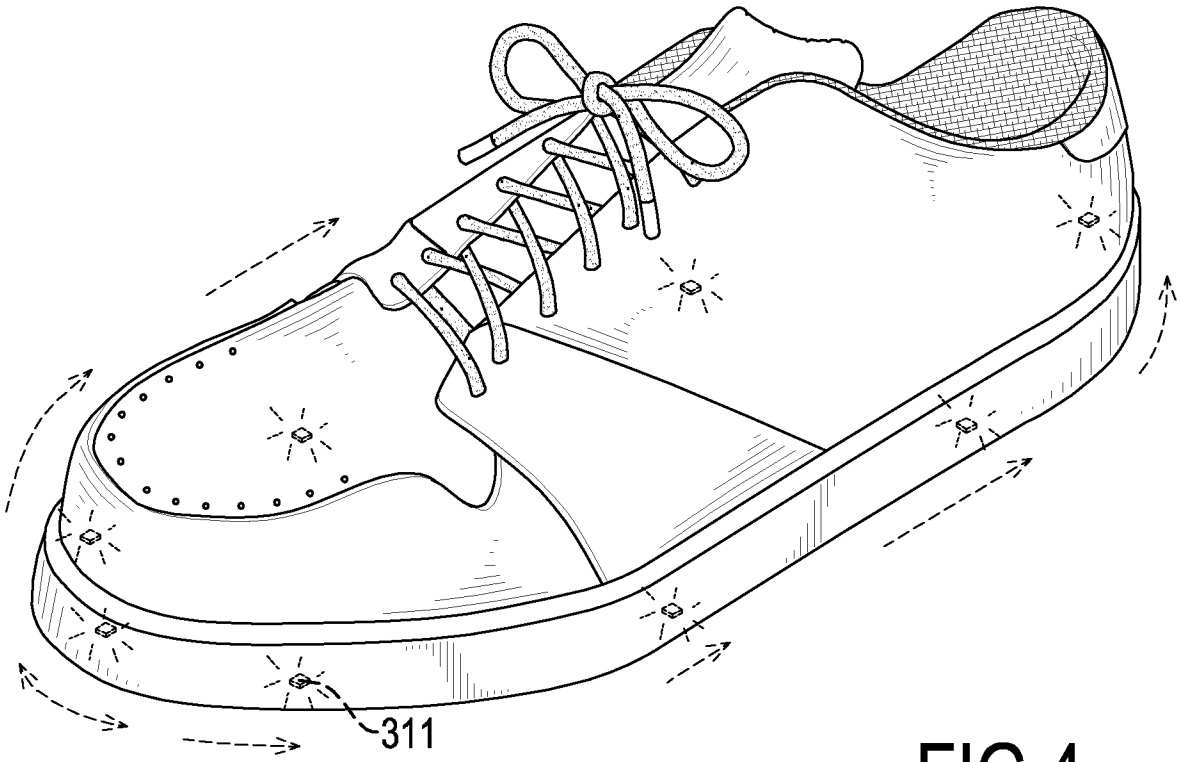
FIG. 4 is an operational perspective view of the illuminant shoe in FIG. 1.
Figure 7:
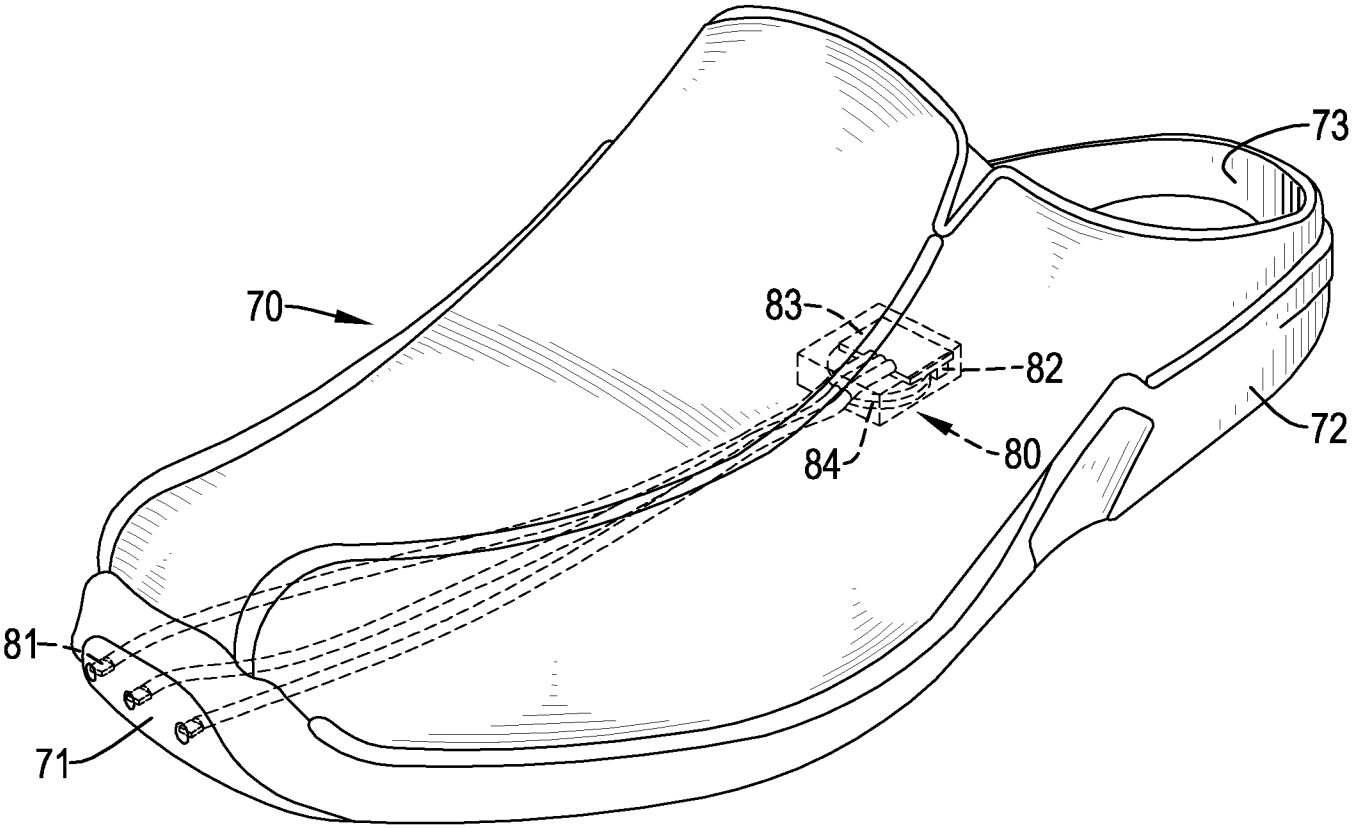
FIG.7 PRIOR ART
FIG. 7 is a perspective view of an illuminant shoe in accordance with the prior art.

In use, with reference to FIG. 4, when the switch 32 is pressed, the switch 32 will send a signal to the controlling module 33 via the third wire and the third electrical element 321. When the controlling module 33 receives the signal that is sent from the switch 32, the controlling unit 332 will drive the illuminating elements 311 of the illuminating module 31 to turn on or off so as to provide a radial visible effect. Preferably, the illuminating elements 311 may be turned on or turned off in a sequence in a clockwise direction, a counterclockwise direction or a random type. In addition, the illuminating elements 311 also can emit lights in different colors, so a versatile visual and decorative effect is provided without being limited in the front segment 71 of the body 70 as a conventional one shown in FIG. 7.

Figure 6:
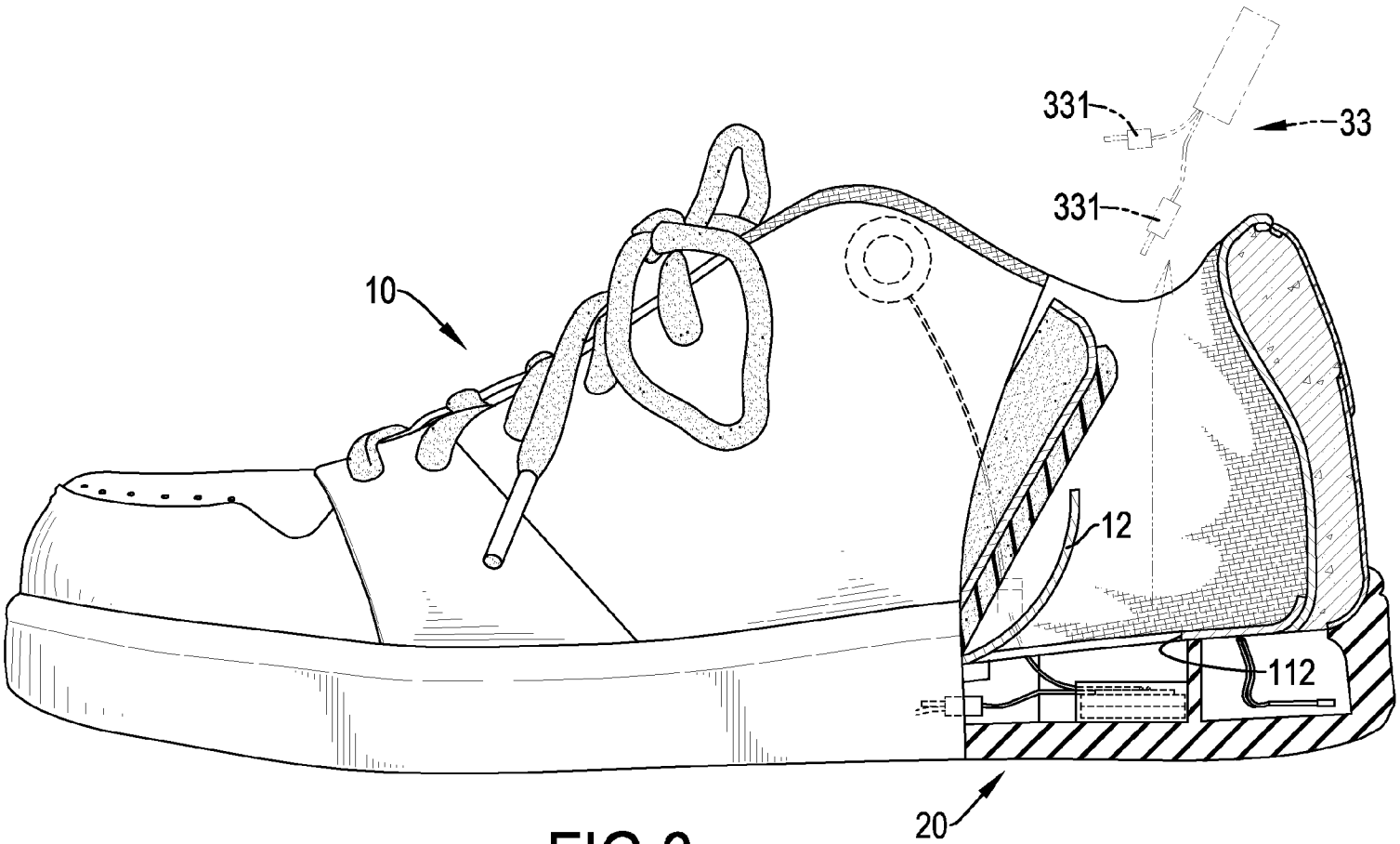

With reference to FIGS. 5 and 6, when the power of the battery 333 is used up, the user can remove the insole 13 and lift the lifting cover 12 to detach and separate the controlling module 33 from the electrical elements 312, 321 of the illuminating module 31 and the switch 32 and to get out of the mounting chamber 21 of the outsole 20. Then, the user can replace a new controlling module 33 into the mounting chamber 21 of the outsole 20 and to connect to the illuminating module 31 and the switch 32, and a different visible effect can be provided. Furthermore, the translucent outsole 20 further can provide a different visible effect for the illuminant shoe when the illuminating elements 311 emit lights out of the outsole 20.

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An illuminant shoe having a body having a putting segment having a bottom;

a rear end;

a heel lining mounted in the bottom of the putting segment; and a through hole formed through the heel lining near the rear end of the putting segment;

a lifting cover connected to the heel lining to cover the through hole and having a capability of being lifted upward relative to the heel lining of the putting segment; and an insole mounted in the putting segment and abutting the heel lining and the lifting cover;

an outsole mounted on the bottom of the putting segment of the body and having a top;

a bottom;

an external sidewall; and a mounting chamber formed in the top of the outsole and between the heel lining of the putting segment, the lifting cover and the bottom of the outsole and communicating with the through hole of the putting segment; and an illuminating device mounted in the mounting chamber of the outsole and having an illuminating module mounted in the mounting chamber of the outsole and having multiple first wires mounted in the mounting chamber of the outsole and extending to the external sidewall of the outsole, and each first wire having an extending end extending to the external sidewall of the outsole; and a connecting end;

multiple illuminating elements respectively connected to the extending ends of the first wires and extending out of the external sidewall of the outsole to emit lights out of the outsole; and a first electrical element connected to the connecting ends of the first wires of the illuminating module;

a controlling module mounted in the mounting chamber of the outsole below the lifting cover, electrically and detachably connected to the illuminating module and having two second electrical elements, one of the second electrical elements connected to the first electrical element of the illuminating module;

multiple second wires connected to the second electrical elements;

a controlling unit mounted in the mounting chamber of the outsole and electrically connected to the second wires;

a battery electrically connected to the controlling unit to supply power to the illuminating module and the controlling module; and a protecting casing mounted in the mounting chamber of the outsole to mount around the controlling unit and the battery; and a switch mounted in the putting segment, detachably connected to the second electrical element of the controlling module that is free from connecting with the first electrical element of the illuminating module and having a third wire mounted in the mounting chamber of the outsole and extending out of the bottom of the putting segment via the heel lining or the lifting cover; and a third electrical element electrical connected to the third wire and electrically connected to the corresponding second electrical element.

2. The illuminant shoe as claimed in claim 1, wherein the extending ends of the first wires of the illuminating module individually extend to the external sidewall of the outsole in a radial direction; and the switch is mounted in the putting segment above the heel lining.

3. The shoe as claimed in claim 2, wherein the outsole is made of a translucent material.

4. The shoe as claimed in claim 1, wherein the outsole is made of a translucent material.

5. The shoe as claimed in claim 1, wherein the illuminating elements are light emitting diodes; and the switch is a pushbutton switch.

6. The shoe as claimed in claim 2, wherein the illuminating elements are light emitting diodes; and the switch is a pushbutton switch.

7. The shoe as claimed in claim 3, wherein the illuminating elements are light emitting diodes; and the switch is a pushbutton switch.

8. The shoe as claimed in claim 4, wherein the illuminating elements are light emitting diodes; and the switch is a pushbutton switch.

* * * * *